United States Patent [19]

Cockman, Jr.

[11] 4,406,184

[45] Sep. 27, 1983

[54] RATCHET HANDLE WITH MULTI-MODE TURNING CAPABILITY

[76] Inventor: Euliss C. Cockman, Jr., Rte. 1, Box 104-B, Carthage, N.C. 28327

[21] Appl. No.: 289,918

[22] Filed: Aug. 4, 1981

[51] Int. Cl.[3] ..... B25B 17/00

[52] U.S. Cl. ..... 81/57.29; 81/58.1

[58] Field of Search ..... 81/57.29, 58.1

[56] References Cited

U.S. PATENT DOCUMENTS

| | | | |
|---|---|---|---|
| 3,707,893 | 1/1973 | Hofman | 81/57.29 |
| 3,824,881 | 7/1974 | Wright | 81/63 |
| 4,086,829 | 5/1978 | Hudgins | 81/58.1 |
| 4,128,025 | 12/1978 | Main et al. | 81/58.1 |
| 4,137,801 | 2/1979 | Imperio | 81/58.1 |
| 4,318,314 | 3/1982 | Furedi et al. | 81/57.29 |

*Primary Examiner*—James L. Jones, Jr.
*Attorney, Agent, or Firm*—Mills & Coats

[57] ABSTRACT

The present invention relates to a ratchet handle having a handle assembly that is operative to turn an associated socket or the like in any one of three different turning modes. First, by oscillating the entire handle assembly about the axis of the socket, the socket is turned in conventional fashion. Secondly, by screwing or rotating either clockwise or counterclockwise the handle assembly about its longitudinal axis, a turning motion is imparted to the associated socket. Thirdly, by imparting a screw-ratchet action to the handle assembly a third mode of effectuating rotation of the socket is achieved.

5 Claims, 3 Drawing Figures

RATCHET HANDLE WITH MULTI-MODE TURNING CAPABILITY

FIELD OF INVENTION

The present invention relates to ratchet wrenches and speed ratchet handles and more particularly to speed ratchet handles of the type designed for multi-operating modes.

BACKGROUND OF INVENTION

Conventional ratchet wrenches have been known and used for sometime. Such conventional ratchet wrenches include a ratchet that is typically oscillated about the axis of its head to impart rotation to the head or socket of the wrench so as to drive an associated socket member or the like. Ratchet wrenches are desirable since they can be actuated in a relatively fast manner for quickly tightening and loosening a nut or a bolt. Further, they are desirable because they are useful in hard to reach applications.

But the ratchet wrench does have some drawbacks. In this regard, it is well appreciated that they are somewhat difficult to use in applications where the bodily movement of the handle is restricted or limited. Further, there is a problem associated with using the ratchet wrench where the bolt or nut is loose. This often occurs in attempting to remove a nut or bolt after it has been broken completely loose. In most cases, the ratchet action is so tight that it will not operate when the bolt is completely loose.

There have been attempts at providing a ratchet type wrench to overcome such shortcomings and problems. In this regard, one is referred to the disclosures in U.S. Pat. Nos. 4,086,289; 4,128,025; 3,707,893; 2,703,030; and 3,707,893.

While these attempts at solving the problem have, at least to some degree, been satisfactory, they have also resulted in very sophisticated and complex wrench designs with many moving parts. In the end, such wrenches and ratchet handles have been expensive, difficult to maintain and manufacture, and because of the complexity have been proned to malfunction and break.

Therefore, there exists a real need for a relatively simple, reliable, efficient ratchet handle assembly that is capable of operating in numerous modes to effectuate the turning of an associated socket.

SUMMARY AND OBJECTS OF INVENTION

The present invention presents a relatively simple, ratchet wrench handle that is provided with a multi-mode turning capability. More particularly, the ratchet wrench handle includes a multi-sectional handle including an axially movable exterior rotary actuator that is movable between first and second positions (locked and unlocked). In a first position, the ratchet handle is operative to turn an associated socket by oscillating, either clockwise or counterclockwise, the handle about the axis of the socket. In the second position, the ratchet handle is operative to turn the same socket, either clockwise or counterclockwise, by rotating the same in a rotary fashion about the longitudinal axis of the ratchet handle. Finally in the same second position, a third mode of operation can be achieved by imparting a ratchet-screwing action to the handle. It should be pointed out that all three modes are capable of tightening or loosening as each mode is controlled by a single ratchet assembly disposed in one end of the handle, opposite the head.

It is, therefore, an object of the present invention to provide a wrench type ratchet handle having multi-mode turning capabilities that is relatively simple, durable, and reliable.

A further object of the present invention is to provide a multi-turning mode ratchet wrench of the character discussed above that is provided with a relatively simple, multi-sectional handle that utilizes a single end disposed ratchet assembly to accommodate all turning modes.

It is still a further object of the present invention to provide a multi-turning mode ratchet handle that includes a head disposed about one end and a ratchet assembly disposed about the other end opposite said handle for setting the direction of turn for each mode of turning capability.

It is also an object of the present invention to provide a wrench type ratchet handle of the multi-turning mode type discussed above that comprises a minimum number of moving parts and which is easy to manufacture and assemble.

Other objects and advantages of the present invention will become apparent from a study of the following description and the accompanying drawings which are merely illustrative of the present invention.

MULTI-TURNING MODE RATCHET HANDLE

Figure 1:
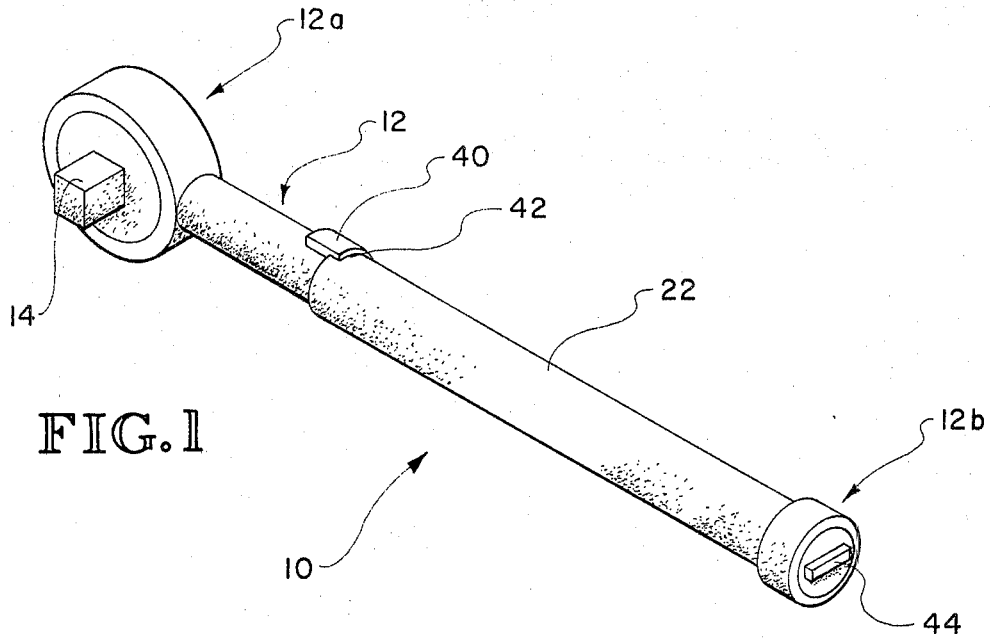
FIG. 1 is a perspective view of the multi-turning mode wrench type ratchet handle of the present invention.

With further reference to the drawings, the multi-turning mode wrench type ratchet handle of the present invention is shown therein and indicated generally by the numeral 10.

Viewing ratchet handle 10 in more detail, the same comprises a multi-sectional handle assembly, indicated generally by the numeral 12, that includes a head portion **12*a* and ratchet end 12*b***.

Head portion **12*a* includes a drive stud 14** that is rotatively journaled within the head portion of the ratchet handle.

Forming a part of handle assembly 12 is an intermediate handle housing 16 that includes a generally cylindrical hollow bore **16*a* formed therein. Rotatively journaled within intermediate handle housing 16 is a cylindrical rotary drive member 18. It is seen that intermediate housing 16 generally surrounds rotary drive member 18 and an open area formed about the head portion that includes drive means 20 in the form of two engaged beveled gears, one beveled gear being secured to said rotary drive member 18 and the other being secured to drive stud 14**.

About the ratchet end of handle assembly 12, the rotary drive member 18 is provided with a hollow receiving cavity **18*a* that extends a selected length from the end adjacent the ratchet end 12*b*** towards the head portion of the handle assembly.

Rotatively journaled about intermediate handle housing 16 is a rotary actuator 22. Rotary actuator 22 includes an end section that includes a ratchet assembly 24 and a driver 26 that extends from the ratchet assembly 24 into the hollow receiving cavity 18*a* of the rotary drive member 18. It is to be appreciated that the cylindrical wall of rotary actuator 22, ratchet assembly 24, and driver 26 are all integrally constructed such that rotation, either clockwise or counterclockwise, of the cylindrical wall portion of rotary actuator 22 results in the rotation of driver 26.

To retain rotary actuator 22 about handle assembly 12, there is provided an annular slot 28 formed completely around intermediate handle housing 16. A retaining pin or screw 30 extends through the cylindrical wall of rotary actuator 22 adjacent slot 28 and extends into the plane of the slot so as to assure the confinement of rotary actuator 22 about handle assembly 12 as long as the retaining pin 30 projects into the plane of the slot.

Rotary actuator 22 is designed to be axially movable along the longitudinal axis of handle assembly 12 between a first locked position and a second unlocked position. In the locked position, handle assembly 12 is designed such that the rotary actuator 22 is locked for rotation and remains generally stationary with intermediate handle housing 16. In the first or locked position, rotary actuator 22 assumes an extreme left position as viewed in FIGS. 2 and 3. In this position, a receiving cutout 42 formed about one end of the rotary actuator 22 receives a locking strap 40 formed about an adjacent portion of the intermediate handle housing 16. The engagement of cutout 42 with locking strap 40 prohibits rotation of rotary actuator 22 with respect to intermediate handle housing 16.

To maintain rotary actuator 22 in a set position, the handle assembly 12 is provided with detent means. This detent means includes a ball 32 and spring 34 that is adapted to engage and set within either of two annular detents or cavities 36 and 38. In the locked position, it is appreciated that the ball 32 is received within detent 38.

When rotary actuator 22 is moved to an extended or second locked position, it is seen that detent or groove 36 then receives ball 32. The force of spring 34 maintains ball 32 in a retaining engagement with either detent cavity 36 or 38.

Figure 2:
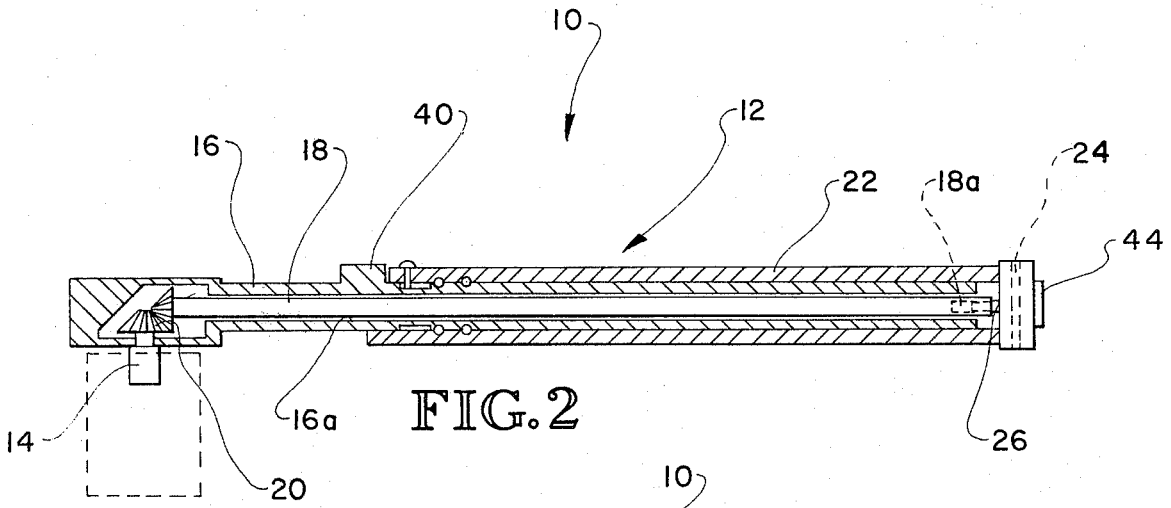
FIG. 2 is an elongated sectional view of the wrench type ratchet handle of the present invention.
Figure 3:
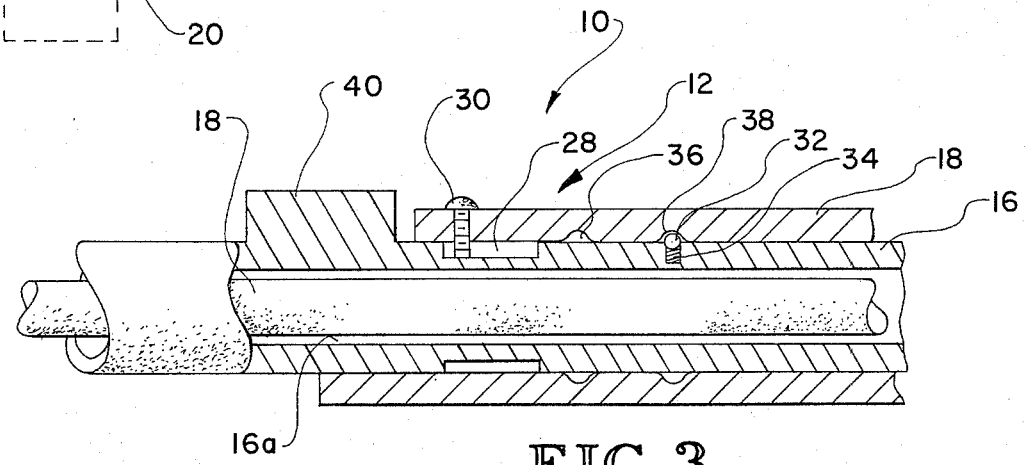
FIG. 3 is a fragmentary enlarged sectional view of an intermediate portion of the ratchet handle of the present invention.

In the locked position or the position shown in FIGS. 1 through 3, the handle assembly 12 is adapted to turn an associated socket in a conventional fashion by oscillating the entire handle assembly 12 about the axis of rotation of drive stud 14. It is important to appreciate that ratchet assembly 24 disposed in the lower or remote end of handle assembly 12 can be set to be stationary in one direction while ratcheting in the other direction and vice versa in order to give the handle assembly 12 the capability to drive in either a clockwise or counterclockwise direction.

Once the rotary actuator 22 is moved to the second or unlocked position where ball 32 is engaged within detent or groove 36, then the rotary actuator 22 can be rotated either clockwise or counterclockwise about the longitudinal axis of the entire handle assembly 12 and relative to intermediate handle housing 16. It is appreciated that rotation of the rotary actuator 22 about this axis will result in driver 26 turning rotary drive member 18 that will in turn cause the drive stud 14 and any associated socket to be accordingly turned. Again, the very same ratchet assembly 24 is operative to allow torque applied turning motion in either clockwise or counterclockwise directions while providing for ratcheting in the opposite direction. This enables the associated socket to be continued to be turned even where there is limited area that prohibits any substantial or significant oscillating motion by the entire handle assembly 12. Further, this enables turning to continue to be achieved even though the article being turned does not have enough drag or resistance to effectuate ratcheting. The above described operation describes the second turning mode of operation of the ratchet handle assembly of the present invention.

Finally in this same second position, the rotary actuator 22 can be turned or rotated a selected degree and then ratcheted back to a point where the rotation can continue. This is referred to as a ratcheting type screw action and differs from the second mode discussed hereinabove in that the rotary actuator 22 is not continuously turned in one direction about its axis but is only turned a certain degree after which it is ratcheted back to a point before continuing to turn the associated socket.

Details of the ratchet assembly 24 are not discussed herein in detail because such is known in the art and various conventional designs may be employed. But it should be pointed out that such a ratchet assembly would include a ratchet wheel drivingly engaged with driver 26 and a series of circumferential teeth extending therearound. A pawl assembly is movably mounted adjacent the ratchet wheel and includes at least two engaging pawls. In one position, a respective pawl engages the teeth of the ratchet wheel and is effective to lock the same against rotation in one direction which effectively allows driver 26 and interconnected rotary drive member 18 to be rotated in that direction. In this same position, the angle of the pawl with respect to the teeth enable the ratchet wheel to ratchet or free wheel in the opposite direction. To accommodate a turning action in the other direction, a ratchet switch, such as that denoted by the numeral 44, is operative to move the pawl assembly to its second position wherein the pawl assembly and at least engaging one pawl is oriented and engaged with the ratchet teeth so as to effect turning and ratcheting in the opposite direction from that found to be the case in the first position. The total effect of such is to allow the present ratchet handle assembly 12 to effectuate turning with torque in both clockwise and counterclockwise directions in all three operative modes.

From the foregoing it is appreciated that the wrench type ratchet handle of the present invention is relative simple and inexpensive, and basically comprised of a minimum number of moving parts in order to assume the capability of multi-turning modes as herein discussed above. In addition, the design and construction of the multi-turning mode ratchet handle of the present invention assures the same is durable, easy to use and maintain, and effective and efficient in operation.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A wrench type ratchet handle designed for both oscillator and rotary actuation, comprising: an elongated handle assembly having upper and lower ends with a head disposed on the upper end of said handle assembly and rotatively mounted for rotation about a first axis that extends generally normal to said handle assembly; said handle assembly including an elongated rotary drive member rotatively mounted within said handle assembly and including upper and lower ends; head drive means operatively interconnected between the upper end of said rotary drive member and said head for driving said head in response to said rotary drive member being rotated about its axis or oscillated about said first axis of said head; said handle assembly further including an intermediate handle housing disposed exteriorly about said rotary drive member and including an integral upper rigid head housing for housing said head drive means; a rotary actuator rotatively journaled about said intermediate handle housing and axially movable relative to said intermediate handle housing between locked and unlocked positions; locking means operatively interconnected between said rotary actuator and said intermediate handle housing for locking the two together when said rotary actuator assumes said locked position such that the two are constrained to move together and in unison and for providing an unlocked relationship in said unlocked position such that said rotary actuator may be rotated about said intermediate handle housing independently of said intermediate housing; reversible ratchet means disposed about the lower end of said handle assembly opposite said head and operatively associated with said rotary actuator for being driven either clockwise or counterclockwise by said rotary actuator while providing rotary ratchet movement in an opposite direction; and rotary drive member drive means operatively and directly interconnected between the lower end of said rotary drive member and said reversible ratchet means for driving or ratcheting said rotary drive member in response to the rotation of said rotary actuator when said rotary actuator assumes said unlocked position, said rotary drive member drive means further preventing said rotary drive member from rotating in one direction while allowing ratchet movement in the opposite direction when said rotary actuator assumes said locked position.

2. The wrench type ratchet handle of claim 2 wherein said locking means includes a latching member fixed to said intermediate handle housing and a latching member receiving area formed on said rotary actuator for receiving said latching member when said rotary actuator is in said locked position such that the engagement of said latching member with said receiving area prohibits rotary movement of said rotary actuator and locks said intermediate handle housing with said rotary actuator.

3. The wrench type ratchet handle of claim 2 wherein detent means is provided in operative relationship between said rotary actuator and said intermediate handle housing and wherein said detent means acts to retain and hold said rotary actuator in said locked and unlocked positions.

4. The wrench type ratchet handle of claim 1 wherein said rotary drive member drive means interconnecting said rotary drive member with said reversible ratchet means includes a turning shaft operatively connected to said reversible ratchet means and wherein said rotary drive member includes a hollow end portion about the lower end thereof opposite said head portion such that said turning shaft may project interiorly therein for engaging and driving said rotary drive member in response to said rotary actuator being turned which in turn drives said reversible ratchet means, which in turn drives said shaft which turns said rotary drive member.

5. The wrench type ratchet type handle of claim 4 wherein there is provided retaining means for retaining said rotary actuator about said intermediate handle housing, and wherein said retaining means includes an annular slot formed circumferentially about the outside of said intermediate handle housing and wherein there is provided a retainer extending through said rotary actuator and having a projecting portion extending into said slot.

* * * * *